US006634933B2

(12) United States Patent
Koshi et al.

(10) Patent No.: US 6,634,933 B2
(45) Date of Patent: Oct. 21, 2003

(54) METHOD, JIG, AND APPARATUS FOR MACHINING ROD LENSES

(75) Inventors: Hiroshi Koshi, Osaka (JP); Kazuto Kase, Osaka (JP); Tsuyoshi Yamane, Osaka (JP); Takashi Mori, Osaka (JP); Kenshu Ando, Osaka (JP)

(73) Assignee: Nippon Sheet Glass Co., Ltd., Osaka (JP)

( * ) Notice: Subject to any disclaimer, the term of this patent is extended or adjusted under 35 U.S.C. 154(b) by 8 days.

(21) Appl. No.: 10/057,195

(22) Filed: Jan. 25, 2002

(65) Prior Publication Data

US 2002/0098781 A1 Jul. 25, 2002

(30) Foreign Application Priority Data

Jan. 25, 2001 (JP) ..... 2001-016841

(51) Int. Cl.[7] ..... B24B 1/00
(52) U.S. Cl. ..... 451/42; 451/240
(58) Field of Search ..... 451/42, 43, 240, 451/255, 256, 277, 323, 367, 384, 390

(56) References Cited

U.S. PATENT DOCUMENTS 1,551,995 A * 9/1925 Lovenston ..... 33/537
4,502,457 A * 3/1985 Marron ..... 125/11.14

FOREIGN PATENT DOCUMENTS

JP 7-89161 6/1988
JP 63251157 * 10/1988 ..... B24B/7/24
JP 2002255580 * 9/2002 ..... C03B/33/06

* cited by examiner

*Primary Examiner*—Dung Van Nguyen
(74) *Attorney, Agent, or Firm*—Sheridan Ross PC

(57) ABSTRACT

A rod lens manufacturing method having satisfactory machining accuracy and enabling mass production. In the method, lens assembly sheets, each holding at least a row of rod lenses, are prepared. The lens assembly sheets are then arranged on holding surfaces defined on a jig. The holding surfaces are inclined relative to a reference surface of the jig by a predetermined angle. Each of the lens assembly sheet is clamped so that optical axes of the rod lenses are inclined relative to a direction perpendicular to the reference surface by that predetermined angle. The lens assembly sheets are then ground and polished.

12 Claims, 7 Drawing Sheets

METHOD, JIG, AND APPARATUS FOR MACHINING ROD LENSES

BACKGROUND OF THE INVENTION

The present invention relates to a method, jig, and apparatus for machining rod lenses.

In the prior art, a method for manufacturing a rod lens is described in, for example, Japanese Examined Patent Publication No. 7-89161. Referring to FIG. 3, the manufacturing method is performed to manufacture a rod lens 11 having parallel end surfaces 63, 20*a* and an inclined surface 20*b*, which is inclined relative to the end surfaces 63, 20*a* by angle θ. The prior art manufacturing method will now be discussed with reference to FIGS. 1 and 2.

Referring to FIG. 1A, a plurality of mother rod lenses 11A are held in a frame 12, which includes two glass plates 13. The two sides of the frame 12 are each fixed to a frame spacer 14. This forms a lens assembly sheet block 15. In this state, the mother rod lenses 11A are arranged so that their axes are aligned along a straight line 10. The lens assembly sheet block 15 is then cut into lens assembly sheets 18, each having a desired thickness L. The cut surfaces of each lens assembly sheet 18 are then polished to form parallel polished surfaces 16, 17 (refer to FIG. 1B).

Referring to FIG. 2A, machining sheets 61, 62, which are glass plates or the like, are fixed to the polished surfaces 16, 17 with an adhesive. Then, the machining sheet 61 is polished to form a polished surface 61*a*, which is inclined relative to the polished surface 16 of the lens assembly sheet 18 by angle θ (FIG. 2B). Subsequently, the machining sheet 62 is polished parallel to the polished surface 61*a* to form the inclined surface 20*b* on each rod lens 11 (FIG. 2C). The machining sheets 61, 62 are then removed from the lens assembly sheet 18. The remaining surface 20*a* of each rod lens 11 adjacent to the inclined surface 20*b* is then machined and mirror finished so that it has a predetermined length A. Finally, the rod lenses 11 are removed from the frame 12. Each rod lens 11 is shaped as shown in FIG. 3.

However, when performing the above process, the adhering of the machining sheets 61, 62 to the lens assembly sheet 18 and the polishing of the sheets 61, 62 consume time. Thus, mass-production is difficult and manufacturing costs are high. Further, since the machining sheets 61, 62 are fixed to the lens assembly sheet 18 with an adhesive, the thickness of the resulting adhesive layer is not uniform. This leads to another shortcoming in which the angle θ of the inclined surfaces 20*b* and the length A of the remaining surfaces 20*a* are not constant.

SUMMARY OF THE INVENTION

It is an object of the present invention to provide a method, jig, and apparatus for machining rod lenses that has satisfactory machining accuracy and enables mass-production.

To achieve the above object, the present invention provides a method for machining rod lenses. The method includes preparing a plurality of lens assembly sheets, each holding at least a row of rod lenses. The plurality of lens assembly sheets are arranged on a plurality of holding surfaces defined on a jig. The plurality of holding surfaces are inclined relative to a reference surface of the jig by a predetermined angle. The method also includes clamping each of the lens assembly sheet with a clamp to hold the lens assembly sheet so that optical axes of the rod lenses are inclined relative to a direction perpendicular to the reference surface by the predetermined angle, grinding the plurality of lens assembly sheets, and polishing the plurality of lens assembly sheets.

A further perspective of the present invention is a method for arranging rod lenses to grind and polish the rod lenses. The method includes preparing a plurality of lens assembly sheets, each holding at least a row of rod lenses. The plurality of lens assembly sheets are arranged on a plurality of holding surfaces defined on a jig. The plurality of holding surfaces are inclined relative to a reference surface of the jig by a predetermined angle. The method also includes clamping each of the lens assembly sheet with a clamp to hold the lens assembly sheet so that optical axes of the rod lenses are inclined relative to a direction perpendicular to the reference surface by the predetermined angle.

A further perspective of the present invention is a machining jig used to perform at least one of grinding a rod lens and polishing a rod lens. The rod lens is fixed in a lens assembly sheet. The jig includes a reference surface, and a support arranged on the reference surface and having a holding surface on which the lens assembly sheet is held. The holding surface is inclined relative to the reference surface by a predetermined angle.

A further perspective of the present invention is an apparatus for machining a rod lens fixed in a lens assembly sheet. The apparatus includes a machining jig used to perform at least one of grinding the rod lens and polishing the rod lens. The jig includes a reference surface and a support arranged on the reference surface and having a holding surface for holding the lens assembly sheet. The holding surface is inclined relative to the reference surface by a predetermined angle. The apparatus also includes an index table on which the machining jig is arranged.

A further perspective of the present invention is an apparatus for machining a rod lens fixed in a lens assembly sheet. The apparatus includes a machining jig used to perform at least one of grinding the rod lens and polishing the rod lens. The jig includes a reference surface and a support arranged on the reference surface and having a holding surface for holding the lens assembly sheet. The holding surface is inclined relative to the reference surface by a predetermined angle. The apparatus also includes a table on which the machining jig is arranged.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1A:
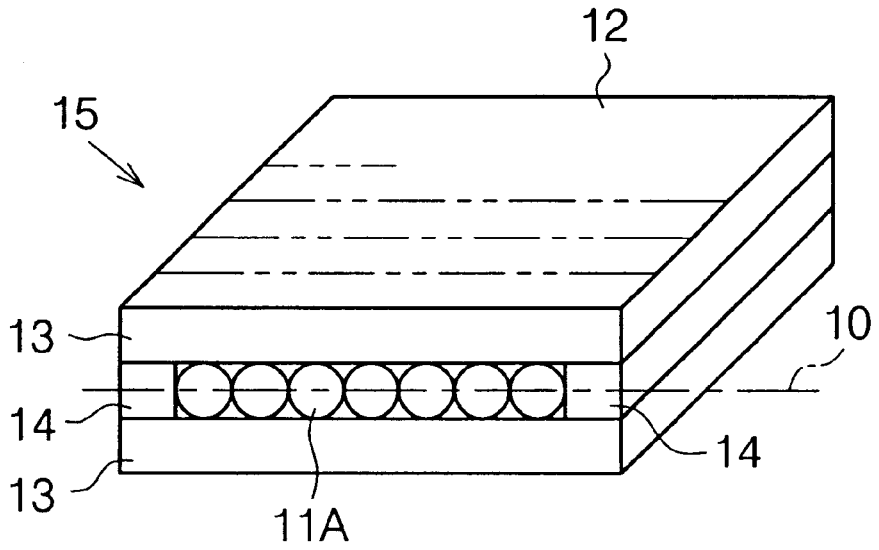
Fig.1A (Prior Art)
FIG. 1A is a perspective view showing a prior art lens assembly sheet block.

In the drawings, like numerals are used for like elements throughout.

A method, jig, and apparatus for machining rod lenses according to a first embodiment of the present invention will now be described with reference to FIGS. 1A and 1B and FIGS. 4 to 10.

In the first embodiment, the process for forming a lens assembly sheet 18 is the same as that of the prior art. As shown in FIG. 1A, a plurality of mother rod lens 11A are held in a frame 12, which includes two glass plates 13. The two sides of the frame 12 are each fixed to a frame spacer 14. This forms a lens assembly sheet block 15. In this state, the mother rod lenses 11A are arranged so that their axes are aligned along a straight line 10.

Figure 1B:
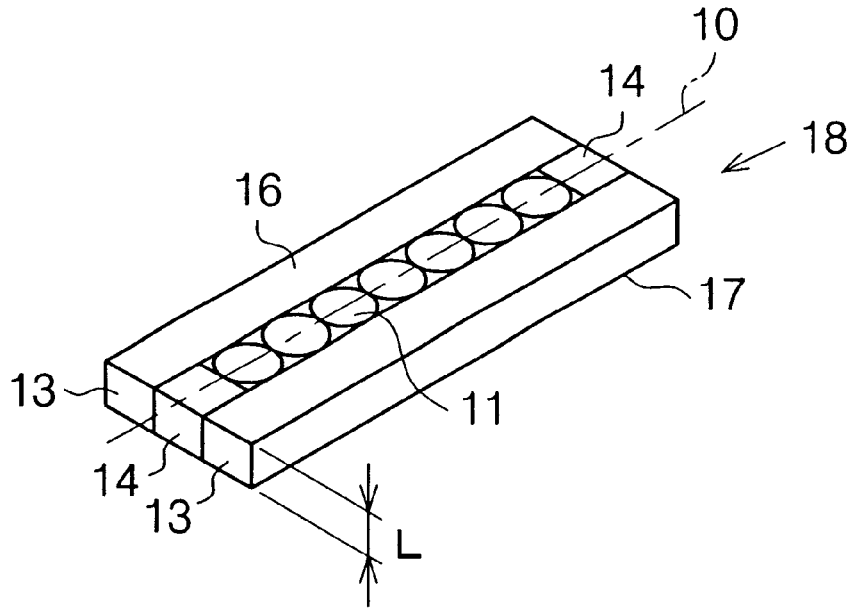
Fig.1B (Prior Art)
FIG. 1B is a perspective view showing a prior art lens assembly sheet.
Figure 2A:
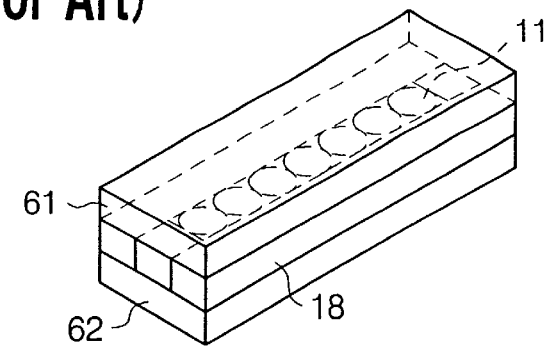
Fig.2A (Prior Art)
FIGS. 2A–2C are perspective views illustrating the machining of the prior art lens assembly sheet.
Figure 2B:
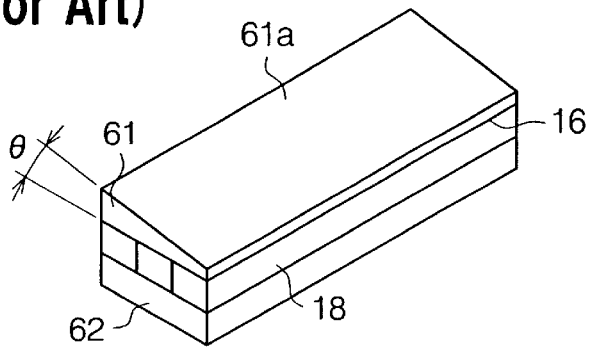
Fig.2B (Prior Art)
Figure 2C:
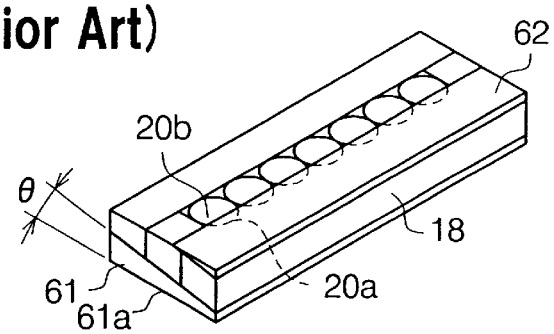
Fig.2C (Prior Art)

The mother rod lenses 11A are adhered integrally to one another in the frame 12. The lens assembly sheet block 15 is then cut into lens assembly sheets 18, each having a desired thickness L, as shown in FIG. 1B. The cut surfaces of each lens assembly sheet 18 are then polished to form parallel polished surfaces 16, 17.

Figure 4:
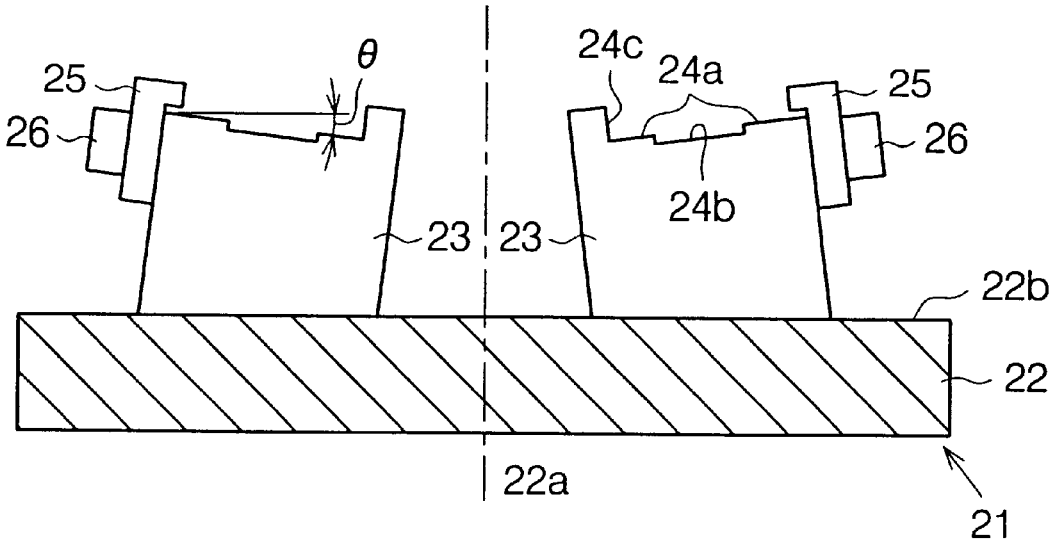
FIG. 4 is a cross-sectional view showing a machining jig according to a first embodiment of the present invention.

A machining jig 21 of the first embodiment for machining the lens assembly sheet 18 will now be discussed. Referring to FIG. 4, the jig 21 includes a base plate 22, which has an upper surface serving as a reference surface, and a plurality (in the first embodiment, two) of supports 23. The supports 23 are equally spaced about the center 22*a* of the base plate 22 in an annular region. The center of the annular region coincides with the center 22*a* of the base plate 22.

Each support 23 includes a holding surface 24*a* and a clamp. The holding surface 24*a* is inclined to the reference surface 22*b* of the base plate 22 by angle θ. A pit 24*b* is formed in the holding surface 24*a*. The diameter of the pit 24*b* is greater than that of the rod lens 11. The clamp includes a seat surface 24*c*, an L-shaped jaw 25, and a screw 26. The seat surface 24*c* projects from the holding surface 24*a*.

Figure 3:
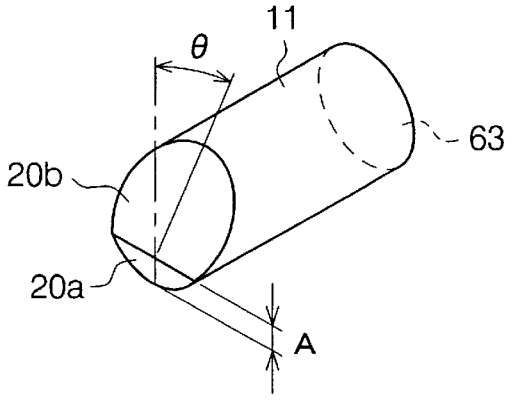
Fig.3 (Prior Art)
FIG. 3 is a perspective view showing a rod lens in the prior art.
Figure 5:
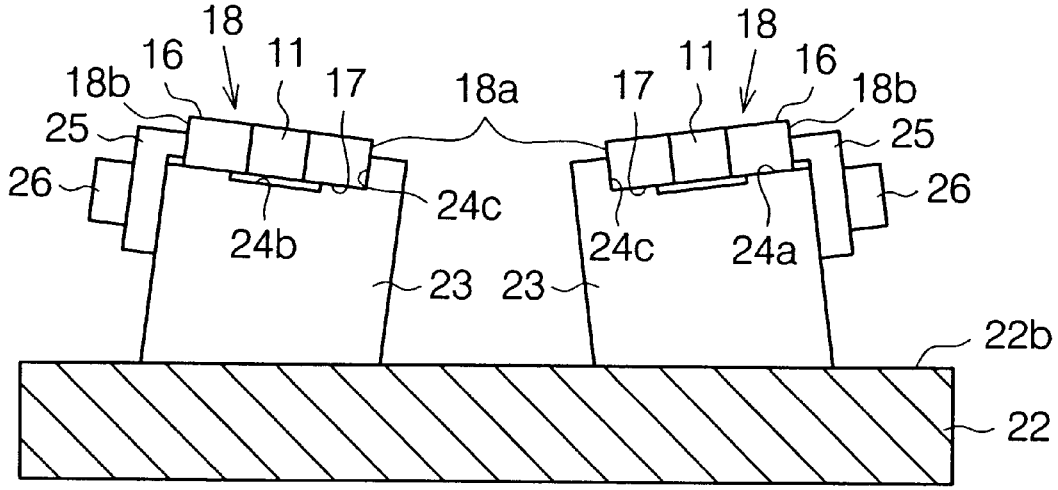
FIG. 5 is a cross-sectional view showing the machining jig of the first embodiment.

Referring to FIG. 5, a lens assembly sheet 18 is placed on the holding surface 24*a* of each support 23 so that its polished surface 17 contacts the holding surface 24*a* of the support 23 and its end surface 18*a* contacts the seat surface 24*c*. The screw 26 is then fastened with the jaw 25 pressing the other end surface 18*b* of the lens assembly sheet 18. Accordingly, the lens assembly sheet 18 is set on the holding surface 24*a* so that the optical axis of the rod lens 11 is inclined by angle θ relative to a direction perpendicular to the reference surface 22*b*. The lens assembly sheet 18 is fixed to the support 23 without the end surfaces (polished surfaces) 63 (FIG. 3) of the rod lenses 11 contacting the holding surface 24*a*.

Figure 6A:
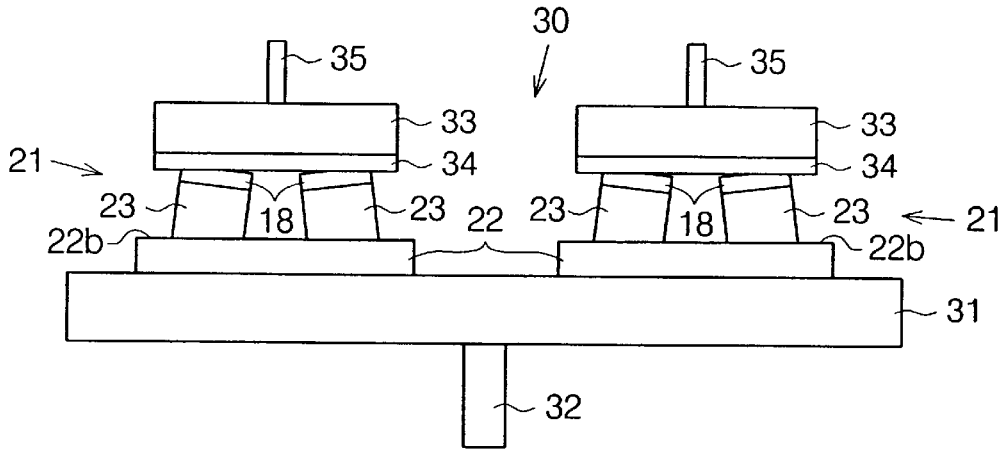
FIG. 6A is a front view showing a grinding apparatus according to the first embodiment of the present invention.
Figure 7:
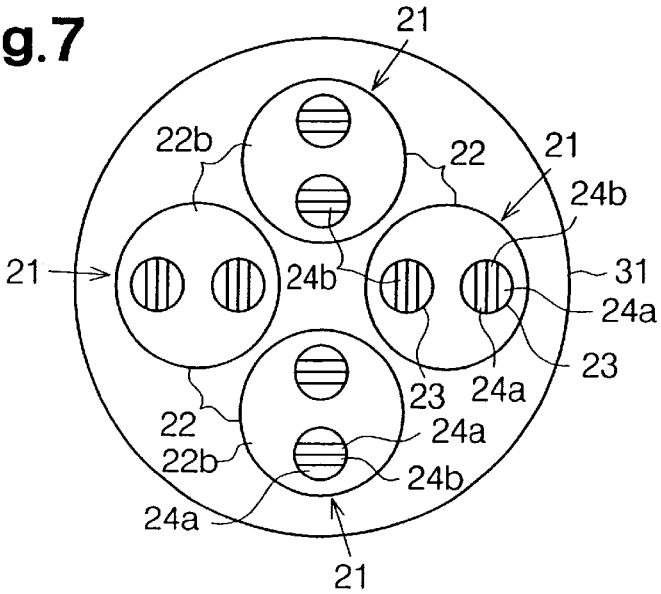
FIG. 7 is a schematic view showing the layout of the machining jig of FIG. 6A.

Referring to FIG. 6A, a grinding apparatus 30 includes a rotating table 31, which is an index table and rotates about a shaft 32. The rotating table 31 is intermittently rotated so that it is indexed every predetermined angle (in the first embodiment, every 90 degrees). Referring to FIG. 7, a plurality of the machining jigs 21 (in the first embodiment, four) is fixed to the upper surface of the rotating table 31 by, for example, screws (not shown).

As shown in FIG. 6A, a plurality of rotary grindstones 34 are arranged above the rotating table 31. The rotary grindstones 34 include a roughing grindstone and a finishing grindstone. The rotary grindstones 34 are each fixed to a rotary body 33 and rotated about a shaft 35 of the rotary body 33.

The jigs 21, each of which holds a lens assembly sheet 18, is fixed to predetermined positions on the rotating table 31. The rotating table 31 is intermittently rotated to sequentially arrange the lens assembly sheets 18 at a machining position opposing one of the rotary grindstones 34. The rotary grindstones 34 grind the lens assembly sheets 18 in the order of rough grinding, middle grinding, and finish grinding. The plurality of rotary grindstones 34 simultaneously perform different types of grinding on the lens assembly sheets 18.

The reference surface 22*b* of each base plate 22 is parallel to the grinding surfaces of the rotary grindstones 34. Thus, the lens assembly sheets 18 are ground on the corresponding holding surfaces 24*a* inclined by angle θ. The distance between each base plate 22 and the rotary grindstones 34 is measured prior to the grinding. The distance is measured again during the grinding. The amount of material ground from the lens assembly sheets 18 is obtained from the difference between the distances. Thus, a predetermined amount of material may be removed from the lens assembly sheets 18 by monitoring the distance between each base plate 22 and the rotary grindstones 34 during the grinding. Then, the jigs 21 are removed from the rotating table 31 with the lens assembly sheets 18 attached to the jigs 21. Cutting chips, abrasive grains, and grinding liquid are washed away from the jigs 21 and the lens assembly sheets 18. The lens assembly sheets 18 are then removed from the jigs 21 and washed again.

Figure 6B:
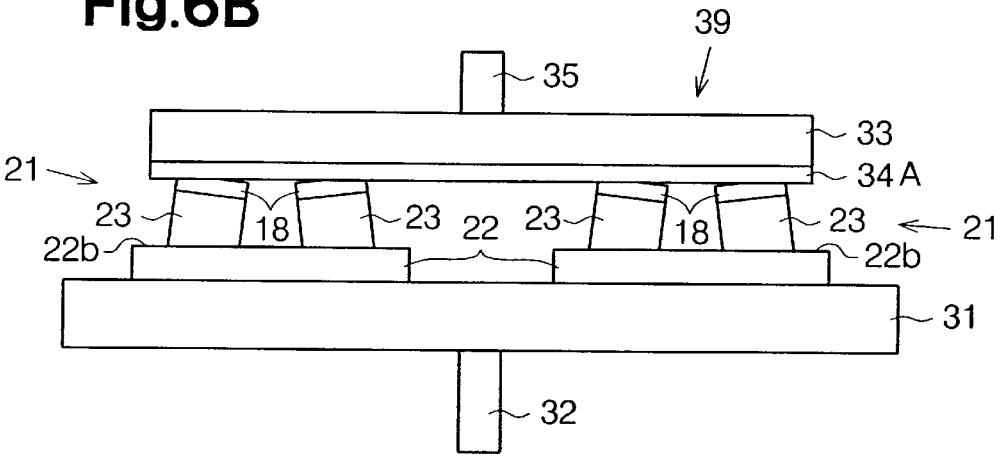
FIG. 6B is a front view showing a further grinding apparatus according to the first embodiment of the present invention.

A grinding apparatus 39 shown in FIG. 6B may be employed in lieu of the grinding apparatus 30 of FIG. 6A to grind the lens assembly sheets 18. The grinding apparatus 39 includes a single rotary grindstone 34A, which simultaneously covers a plurality of the lens assembly sheets 18. Thus, the plurality of the lens assembly sheets 18 are simultaneously ground. Since the grinding apparatus 39 has only one type of rotary grindstone, the feed rate per unit time of the rotary grindstone 34A is adjusted to perform the rough and finish grinding. Rough grinding is performed when the feed rate per unit time is large, and finish grinding is performed when the feed rate per unit time is small.

Figure 8:
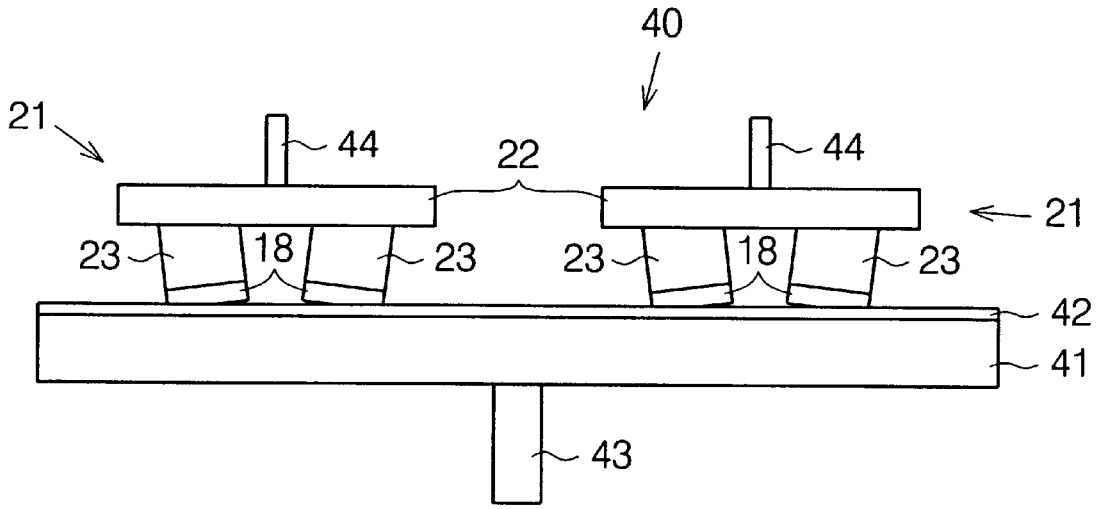
FIG. 8 is a front view showing a polishing apparatus of the first embodiment.

Referring to FIG. 8, a polishing apparatus 40 includes a rotating table 41, which rotates about a rotary shaft 43, a rotary grindstone (polishing body) 42 fixed to the rotating table 41, and the machining jigs 21. The jigs 21 are arranged along a circle, the center of which is the axis of the rotary shaft 43. Each of the jigs 21 includes the support 23 to which a lens assembly sheet 18 is fixed. The jigs 21 are supported in the polishing apparatus 40 so that the reference surface 22*b* of each base plate 22 is parallel to the polishing surface of the rotary grindstone 42. Thus, the lens assembly sheets 18 are polished inclined by angle θ relative to the rotary grindstone 42. The distance between each base plate 22 and the rotary grindstone 42 is measured prior to the polishing. The distance is measure again during the polishing. The amount of material polished from the lens assembly sheets 18 is obtained from the difference between the distances. Thus, a predetermined amount of material is removed by monitoring the distance between each base plate 22 and the rotary grindstone 42 during the polishing.

Figure 9:
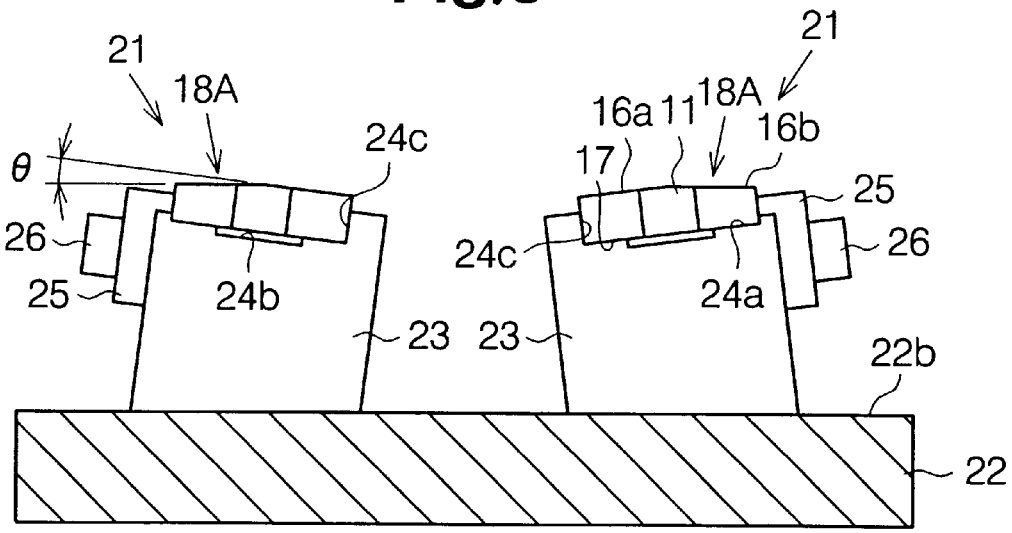
FIG. 9 is a cross-sectional view showing a lens assembly sheet after performing a polishing process according to the first embodiment of the present invention.
Figure 10:
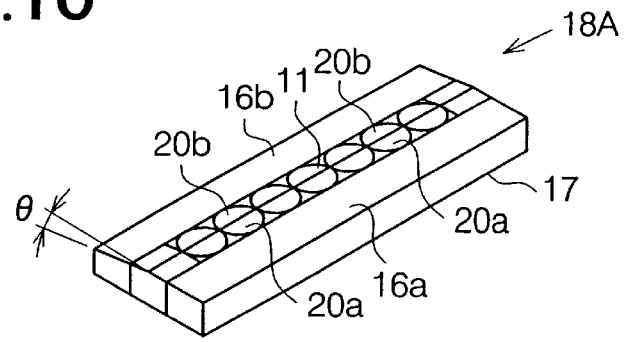
FIG. 10 is a perspective view showing the lens assembly sheet of FIG. 9 after performing the polishing process.

The grinding and polishing forms a remaining polished surface 16*a*, which is parallel to the polished surface 17, and a polished surface 16*b*, which is parallel to the reference surface 22*b*, in each machined lens assembly sheet 18A, as shown in FIGS. 9 and 10. In other words, referring to FIG. 10, a remaining surface 20*a*, which is parallel to the polished surface 16*a*, and an inclined surface 20*b*, which is inclined relative to the remaining surface 20*a* by angle θ, are formed adjacent to each other in each of the rod lenses 11. Finally, the rod lenses 11 are removed from the lens assembly sheet 18A to obtain the rod lenses 11 of FIG. 3.

The grinding and polishing performed in the first embodiment has the advantages described below.

(1) Each machining jig 21 has holding surface 24*a* to which the lens assembly sheets 18 are fixed inclined at the predetermined angle θ. Thus, the rod lenses 11 are easily ground and polished in a state inclined by the predetermined angle θ without using machining sheets.

(2) The reference surface 22*b* of the machining jigs 21 is parallel to the rotary grindstones 34 of the grinding apparatus 30. Thus, the ground amount is easily obtained from the difference of the distances between the reference surface 22*b* and each rotary grindstone 34 prior to and during grinding. Further, the reference surface 22*b* of the machining jigs 21 is parallel to the rotary grindstone 42 of the polishing apparatus 40. Thus, the polished amount is easily obtained from the difference of the distances between the reference surface 22*b* and the rotary grindstone 42 prior to and during polishing. Accordingly, a predetermined amount of material is accurately ground and polished. As a result, the rod lens 11 is formed having the desired lens length and the desired remaining surface length A.

(3) A plurality of the lens assembly sheet 18 are simultaneously ground and polished. Thus, rod lenses are mass-produced.

(4) Due to the pit 24*b*, the polished end surface 63 of each rod lens 11 does not contact the support 23. This prevents the polished end surface 63 from being damaged.

(5) The clamp includes the seat surface 24*c*, the jaw 25, and the screw 26. Thus, the lens assembly sheet 18 is easily attached to and removed from the support 23 by manipulating the screw 26.

(6) The indexing of the rotating table 31 enables rough, middle, and finishing grinding to be successively performed with the lens assembly sheet 18 fixed to the machining jig 21. This reduces the number of operations performed to machine the lens.

(7) A plurality of the lens assembly sheet 18 are simultaneously ground by the single rotary grindstone, which covers every lens assembly sheet 18. This improves manufacturing efficiency.

Figure 11A:
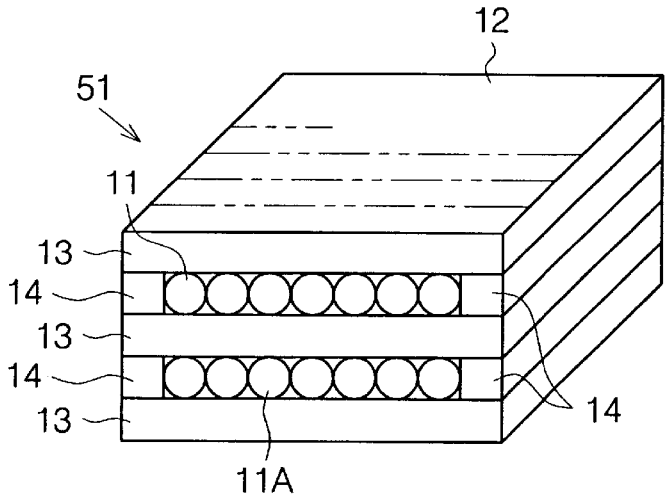
FIG. 11A is a perspective view showing a lens assembly sheet block according to a second embodiment of the present invention.
Figure 11B:
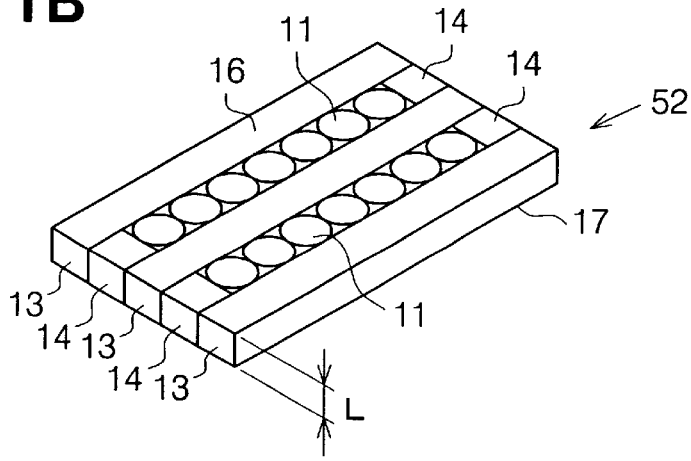
FIG. 11B is a perspective view showing a lens assembly sheet according to the second embodiment.

In a second embodiment of the present invention, the lens assembly sheet 18 of FIG. 1B is replaced by a double row lens assembly sheet 52, which is shown in FIG. 11B. The double row lens assembly sheet 52 includes two rows of the rod lenses 11. Parts differing from the first embodiment will now be described.

Referring to FIG. 11A, a plurality of mother rod lenses 11A arranged in two rows are held by a frame 12A, which has three glass plates 13. Frame spacers 14 are arranged at the sides of the glass plates 13 to form a lens assembly sheet block 51. The mother rod lenses 11A are arranged in each row so that a line connecting their axes are parallel to lines connecting axes of the mother rod lenses 11A in other rows. The mother rod lenses 11A are adhered to one another in the frame 12A. As shown in FIG. 11B, the lens assembly sheet block 51 is cut into double row lens assembly sheets 52, each having a predetermined thickness L. The cut surfaces are polished to form parallel polished surfaces 16, 17.

Figure 12A:
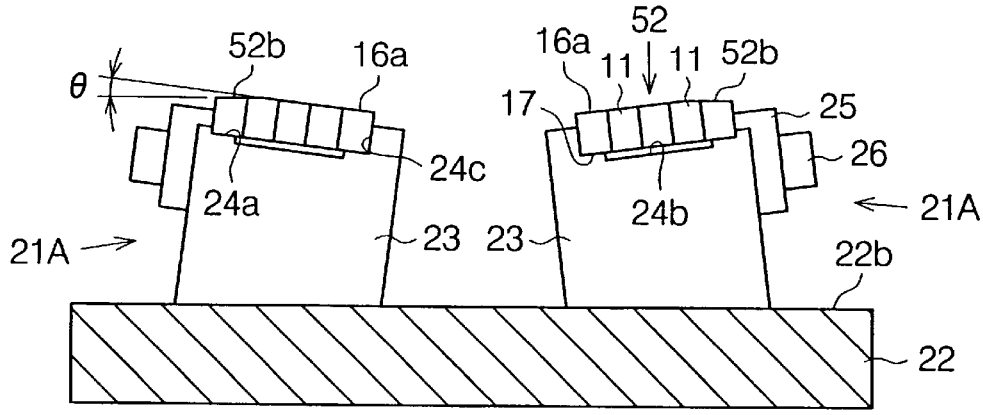
FIGS. 12A and 12B are cross-sectional views showing the lens assembly sheet after performing a grinding process according to the second embodiment of the present invention.

Referring to FIG. 12A, each double row lens assembly sheet 52 is fixed to a machining jig 21A. The machining jig 21 has holding surfaces 24*a*, each of which is wider than the holding surfaces 24*a* of the machining jig 21 in the first embodiment, to hold the wide double row lens assembly sheet 52. A pit 24*b* formed in the holding surface 24*a* is wider than the pit 24*b* of the machining jig 21 in the first embodiment so that the two rows of rod lenses 11 do not contact the holding surface 24*a*.

The double row lens assembly sheet 52 is ground with the grinding apparatus of FIG. 6A or 6B. Referring to FIG. 12A, a predetermined amount of material is ground in the same manner as the first embodiment from a first rod lens row of each double row lens assembly sheet 2. This forms a remaining polished surface 16*a*, which is parallel to the polished surface 17, and a ground surface 52*b*, which is parallel to the base plate 22 and inclined to the polished surface 16*a* by angle θ. The jaw 25 and the screw 26 are then manipulated to remove the double row lens assembly sheet 52 from each machining jig 21. Then, the sides of the double row lens assembly sheet 52 are reversed. In this state, the double row lens assembly sheet 52 is fixed to the jig 21A so that a second rod lens row is located at a grinding position.

Figure 12B:
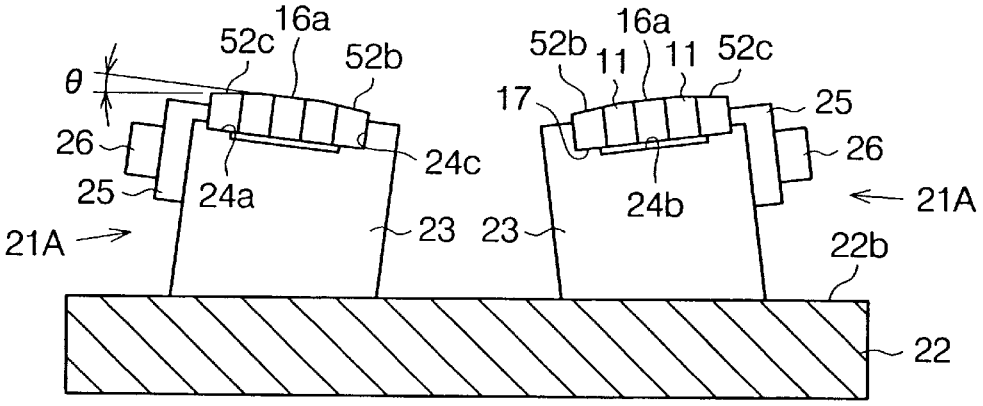

Referring to FIG. 12B, a predetermined amount of material is ground from the second rod lens row. This forms a ground surface 52*c*, which is parallel to the base plate 22 and which is inclined by angle θ relative to the polished surface 16*a*. As a result, the polished surface 16*a*, which is parallel to the polished surface 17, remains in the middle of the double row lens assembly sheet 52. Further, the ground surfaces 52*b*, 52*c*, which are inclined by angle 0 relative to the polished surface 16*a*, are formed with the polished surface 16*a* located in between.

The ground surfaces 52*b*, 52*c* of each double row lens assembly sheet 52 undergo optical polishing with the polishing apparatus 40 of FIG. 8. Like in the first embodiment, a plurality of the double row lens assembly sheet 52 are simultaneously polished. A first polishing surface, or a polished surface 16*c*, is formed by, for example, polishing the ground surface 52*c* with the rotary grindstone 42.

Figure 13:
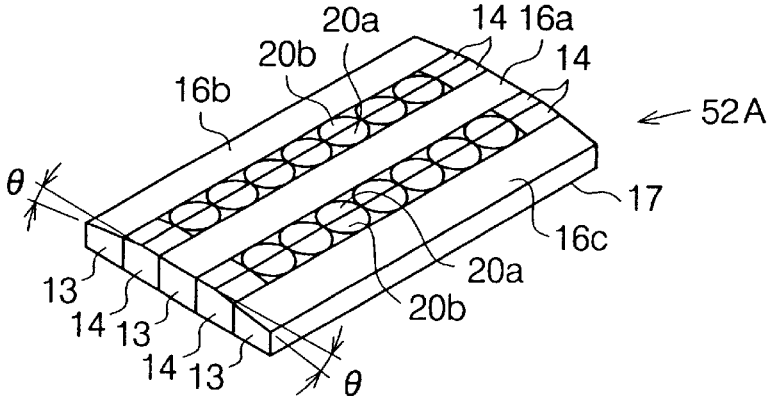
FIG. 13 is a perspective view showing the lens assembly sheet after performing a polishing process of the second embodiment.

Then, the sides of each double row lens assembly sheet 52 is reversed on the corresponding support 23 so that the second ground surface 52*b* opposes the rotary grindstone 42. The second ground surface 52*b* is then polished to form a polished surface 16*b*. As a result, referring to FIG. 13, the polished surface 16*a*, which is parallel to the polished surface 17, remains in the middle of the polished double row lens assembly sheet 52A. Further, the polished surfaces 16*b*, 16*c* inclined by angle θ relative to the polished surface 16*a* are formed with the polished surface 16*a* located in between. In other words, the remaining surface 20*a*, which is parallel to the polished surface 17, and the inclined surface 20*b*, which is inclined by angle θ relative to the polished surface 17, are formed on each of the rod lenses 11, which are arranged in two rows. Finally, the rod lenses 11 are each removed from the lens assembly sheet 52A to obtain the rod lens 11 of FIG. 3.

In addition to the advantages of the first embodiment, the second embodiment has the advantages described below.

The double row lens assembly sheet 52 has two rows of the rod lenses 11. Thus, the rod lenses 11 are mass-produced.

It should be apparent to those skilled in the art that the present invention may be embodied in many other specific forms without departing from the spirit or scope of the invention. Particularly, it should be understood that the present invention may be embodied in the following forms.

A lens assembly sheet may be polished with the polishing apparatus 40 by rotating only the base plate 22 or by rotating the rotary grindstone 42 and the base plate 22.

A lens assembly sheet may be ground and polished on a table that performs indexing by moving in a linear manner.

Instead of using a rotary table, the base plate 22 may be arranged on a fixed table to perform grinding and polishing.

The rotary grindstones 34, 42 may have a grinding surface or a polishing surface inclined at a predetermined angle so that an end surface of each rod lens 11 is formed inclined at angle θ.

The same type of grindstones may be employed as the grindstones 34 of the grinding apparatus 30 shown in FIG. 6A. In such case, the feed rate per unit time of the rotary grindstones 34 may be changed to perform the rough and finish grinding.

Lens assembly sheets may undergo only grinding or undergo both grinding and optical polishing.

In the second embodiment, the ground surface 52*c* may be formed from the first rod lens row of the double row lens assembly sheet 52, and the ground surface 52*c* may be polished afterward to form the polished surface 16*c*. Then, the ground surface 52*b* may be formed from the second rod lens row, and the ground surface 52*b* may be polished afterward to form the polished surface 16*b*.

The present examples and embodiments are to be considered as illustrative and not restrictive, and the invention is not to be limited to the details given herein, but may be modified within the scope and equivalence of the appended claims.

What is claimed is:

1. A method for machining rod lenses, the method comprising the steps of:

preparing a plurality of lens assembly sheets, each holding at least a row of rod lenses;

arranging the plurality of lens assembly sheets on a plurality of holding surfaces defined on a jig, the plurality of holding surfaces inclined relative to a reference surface of the jig by a predetermined angle;

clamping each of the lens assembly sheet with a clamp to hold the lens assembly sheet so that optical axes of the rod lenses are inclined relative to a direction perpendicular to the reference surface by the predetermined angle;

grinding the plurality of lens assembly sheets; and polishing the plurality of lens assembly sheets.

2. The method according to claim 1, wherein the jig includes a base plate, which has the reference surface, and at least one support, which is fixed to the base plate and has one of the plurality of holding surfaces.

3. The method according to claim 2, wherein the clamp is provided on the support.

4. The method according to claim 1, further comprising the step of:

arranging a plurality of the jigs on an index table;

wherein the grinding step includes performing multiple stages of grinding by indexing the index table.

5. The method according to claim 1, further comprising the step of:

arranging a plurality of jigs on a table.

6. The method according to claim 1, wherein the plurality of lens assembly sheets each hold a first rod lens row and a second rod lens row.

7. The method according to claim 6, wherein the grinding step includes grinding the first rod lens row and then grinding the second rod lens row.

8. The method according to claim 6, wherein the polishing step includes polishing the first rod lens row and then polishing the second rod lens row.

9. The method according to claim 6, further comprising the step of:

changing the arrangement of each of the plurality of lens assembly sheets on the associated one of the plurality of holding surfaces after grinding the first rod lens row.

10. A method for arranging rod lenses to grind and polish the rod lenses, the method comprising:

preparing a plurality of lens assembly sheets, each holding at least a row of rod lenses;

arranging the plurality of lens assembly sheets on a plurality of holding surfaces defined on a jig, the plurality of holding surfaces inclined relative to a reference surface of the jig by a predetermined angle;

clamping each of the lens assembly sheet with a clamp to hold the lens assembly sheet so that optical axes of the rod lenses are inclined relative to a direction perpendicular to the reference surface by the predetermined angle.

11. The method according to claim 10, wherein the jig includes a base plate, which has the reference surface, and at least one support, which is fixed to the base plate and has one of the plurality of holding surfaces.

12. The method according to claim 11, wherein the clamp is provided on the support.

* * * * *